US007661581B2

(12) United States Patent
Lin

(10) Patent No.: US 7,661,581 B2
(45) Date of Patent: Feb. 16, 2010

(54) MULTIFUNCTIONAL BOX ORGANIZER

(75) Inventor: Richard Lin, Sijhih (TW)

(73) Assignee: Pop Three Dimensional Picture Co., Ltd., Sijhih, Taipei County (TW)

( * ) Notice: Subject to any disclaimer, the term of this patent is extended or adjusted under 35 U.S.C. 154(b) by 387 days.

(21) Appl. No.: 11/684,615

(22) Filed: Mar. 10, 2007

(65) Prior Publication Data

US 2008/0217273 A1 Sep. 11, 2008

(51) Int. Cl.
*A45C 1/12* (2006.01)

(52) U.S. Cl. ..... 232/1 D; 232/4 R; 446/8

(58) Field of Classification Search ..... 232/4 R, 232/1 D, 43.1; 446/8; 206/0.8, 0.81, 0.815; 116/234; 40/358, 324; 211/126.14
See application file for complete search history.

(56) References Cited

U.S. PATENT DOCUMENTS 1,423,270 A * 7/1922 Smith ..... 232/4 R
D170,574 S * 10/1953 Hickey ..... D99/36
2,943,778 A * 7/1960 Paulsen ..... 206/0.81
4,671,455 A * 6/1987 Stockman ..... 232/1 D
5,038,505 A * 8/1991 Young ..... 40/358
D332,113 S * 12/1992 Yates ..... D19/34
5,193,741 A * 3/1993 Magruder ..... 206/0.815
5,537,369 A * 7/1996 Wu ..... 368/10
6,032,855 A * 3/2000 Douglas ..... 232/17
6,401,649 B1 * 6/2002 Smith ..... 116/234
7,367,145 B2 * 5/2008 Mou ..... 40/324
2004/0074436 A1 * 4/2004 Wu ..... 116/234

FOREIGN PATENT DOCUMENTS

DE 29804502 U1 7/1998

* cited by examiner

*Primary Examiner*—William L. Miller
(74) *Attorney, Agent, or Firm*—Pai Patent & Trademark Law Firm; Chao-Chang David Pai

(57) ABSTRACT

A multifunctional box organizer includes a hollow main body provided with at least one slit, via which magnetic bookmarks may be extended and then bent to magnetically attach to the main body, and a coin slot located at a distance from the slit; an open bottomed enclosure fitly received in a lower part of the main body; and a bottom cover closed to a lower open end of the main body to define a closed storage space in the enclosure. The enclosure is provided with an opening corresponding to the coin slot, so that coins may be inserted through the coin slot and collected in the storage space. Coins collected in the enclosure may be taken out by opening a cap on the bottom cover. A space in the main body above the enclosure is divided by a partition into several subspaces for holding and sorting pens and different articles.

10 Claims, 4 Drawing Sheets

MULTIFUNCTIONAL BOX ORGANIZER

FIELD OF THE INVENTION

The present invention relates to an organizer, and more particularly to a multifunctional box organizer for orderly holding magnetic bookmarks, coins, pens, etc.

BACKGROUND OF THE INVENTION

A magnetic bookmark is a magnet that may be folded for movably clipping one book page or one sheet of paper to serve as an indexing mark. Due to its convenience for use, the magnetic bookmark has been widely used in people's daily life. Currently, there is not any device available in the market for holding magnetic bookmarks, and most people just scatter the magnetic bookmarks over a desk top to cause disorder in a room. Meanwhile, most currently available containers or storage boxes are designed to hold unsorted things without other functions. It is therefore tried by the inventor to develop a multifunctional box organizer for orderly holding different things, such as magnetic bookmarks, pens, coins, etc.

SUMMARY OF THE INVENTION

A primary object of the present invention is to provide a multifunctional box organizer for holding magnetic bookmarks and many other different things in an orderly and convenient manner.

To achieve the above and other objects, the multifunctional box organizer according to the present invention includes a hollow main body provided on a peripheral wall with at least one slit, via which magnetic bookmarks may be extended and then bent to magnetically attach to the main body, and a coin slot located at a distance from the slit; an open bottomed enclosure fitly received in a lower part of the main body; and a bottom cover closed to a lower open end of the main body to together with the enclosure define a closed storage space between them. The enclosure is provided with an opening corresponding to the coin slot on the main body, so that coins and paper money may be inserted through the coin slot and collected in the storage space. Coins collected in the enclosure may be taken out by turning open a cap on the bottom cover.

A space in the main body above the enclosure is divided by a partition into several subspaces for holding and sorting pens and different articles.

A binding frame may be mounted around an upper open end of the main body to increase the structural strength of the box organizer.

A memo pad may be attached to an outer surface of the main body, so as to be easily accessed by a user.

In an embodiment of the present invention, the main body may be a closed annular member with two open ends.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
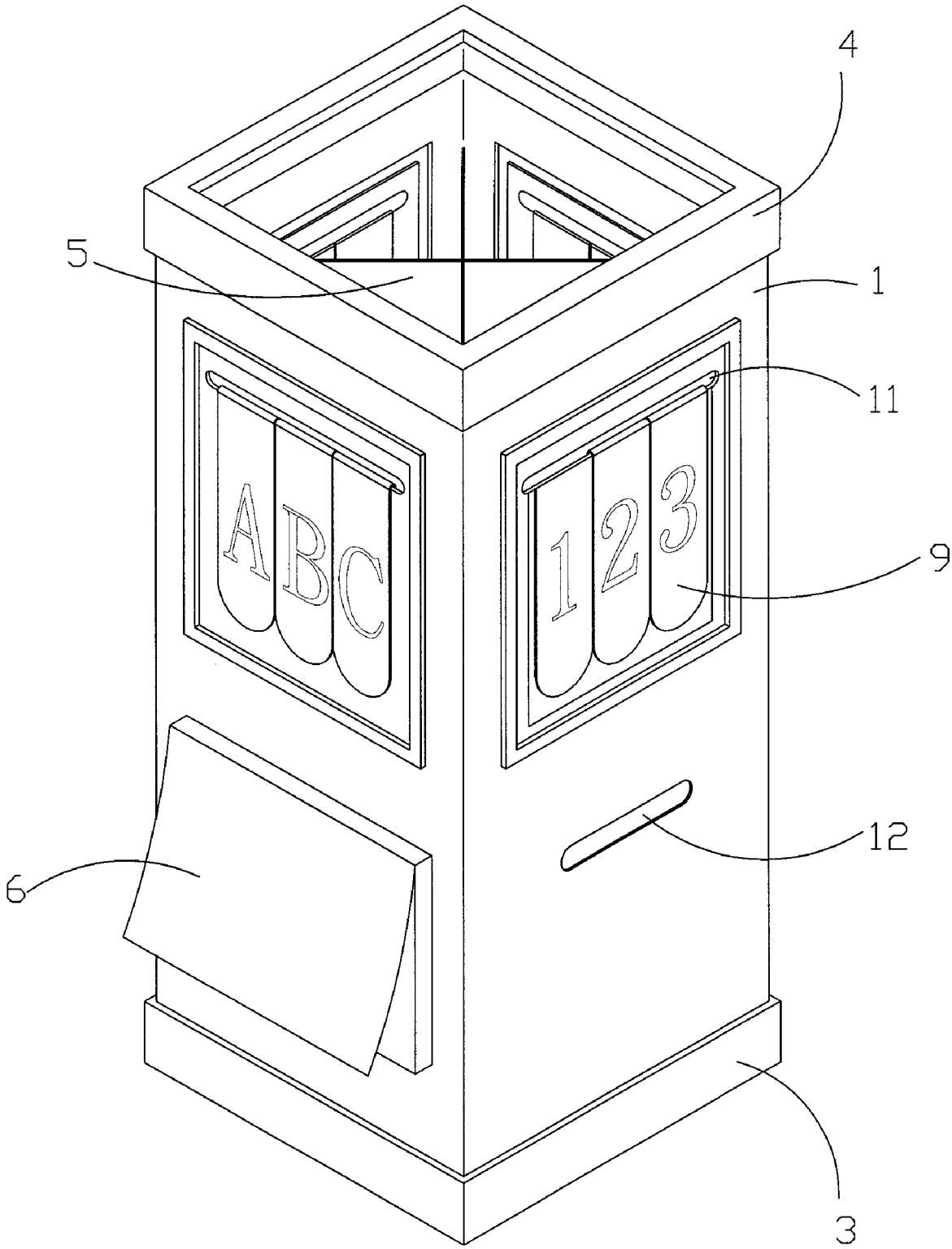
FIG. 1 is an assembled perspective view of a multifunctional box organizer according to a preferred embodiment of the present invention.
Figure 2:
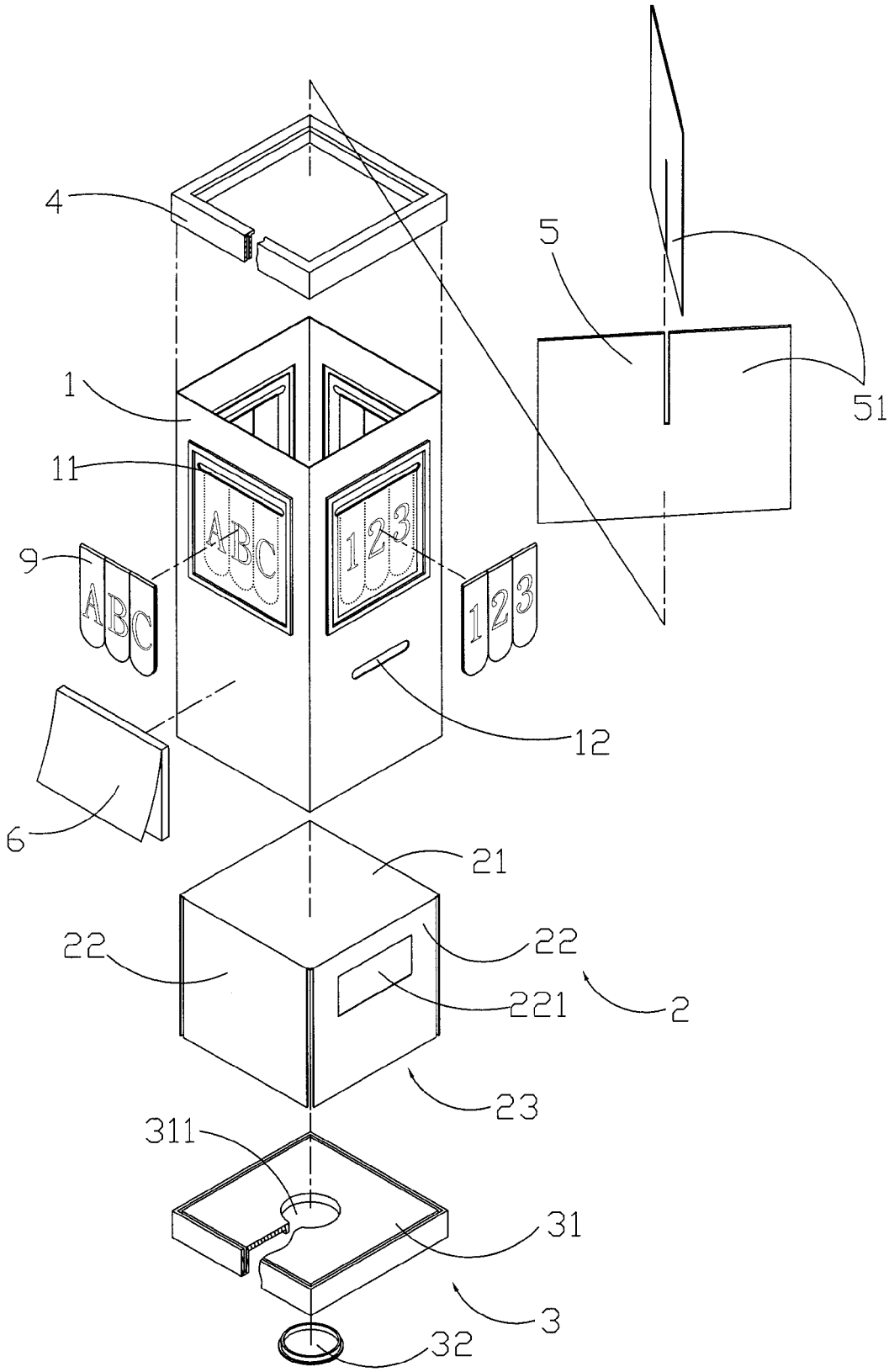
FIG. 2 is an exploded view of FIG. 1.
Figure 3:
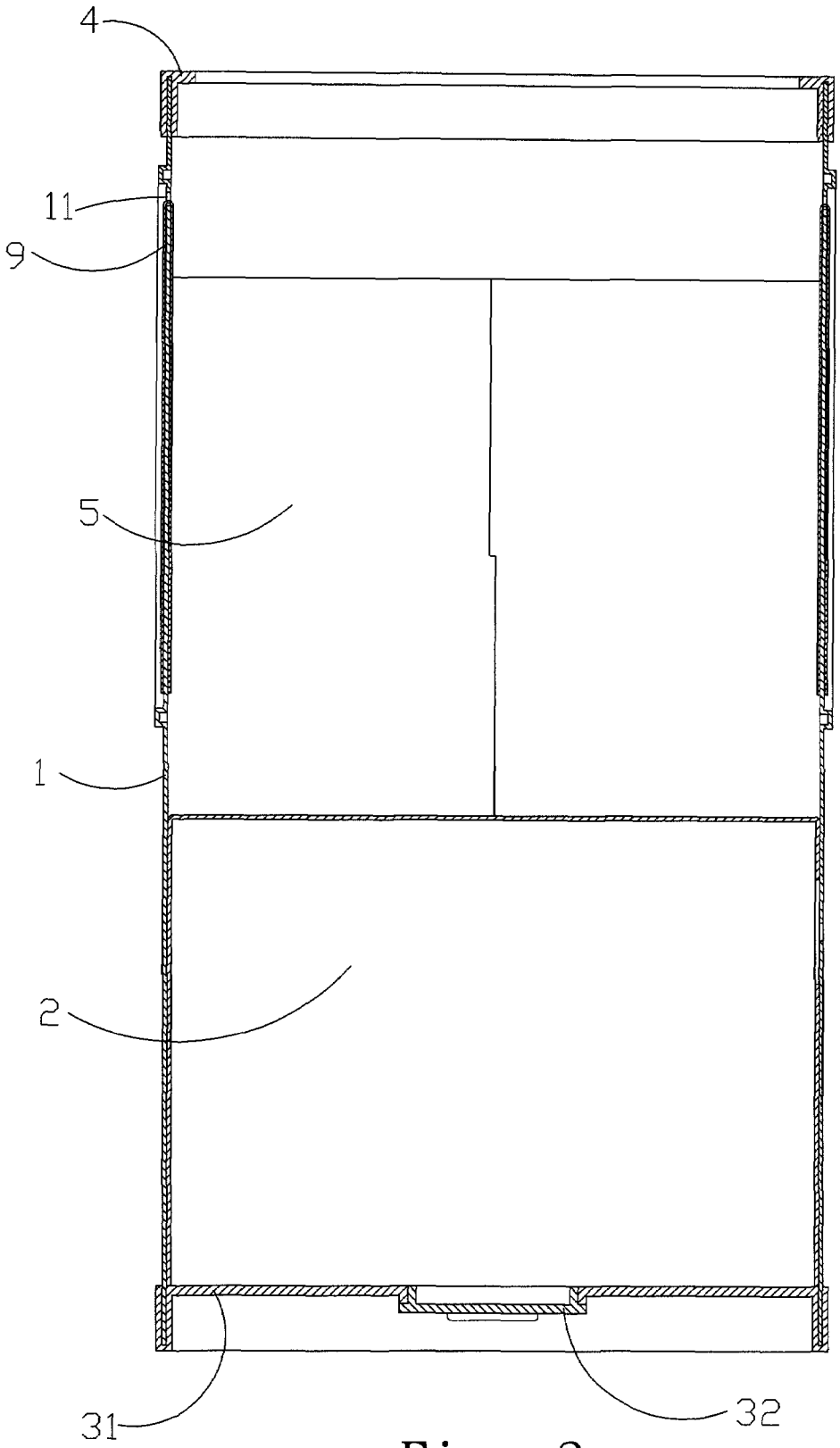
FIG. 3 is a sectioned side view of FIG. 1 showing an internal structure of the present invention.

Please refer to FIGS. 1 and 2 that are assembled and exploded perspective views, respectively, of a multifunctional box organizer according to a preferred embodiment of the present invention, and to FIG. 3 that is a sectioned side view of the box organizer of FIG. 1. As shown, the multifunctional box organizer according to the preferred embodiment of the present invention includes a main body 1, an enclosure 2, a bottom cover assembly 3, a top binding frame 4, and a partition 5.

The main body 1 is a substantially rectangular hollow sleeve having four sides, namely, a front, a rear, a left, and a right side, and two open ends. The four sides are each provided near an upper open end with a horizontal slit 11, via which a plurality of magnetic bookmarks 9 may be partially extended and then bent to thereby orderly hang on and magnetically attach to the main body 1. The hollow main body 1 may also serve as a penholder.

Figure 4:
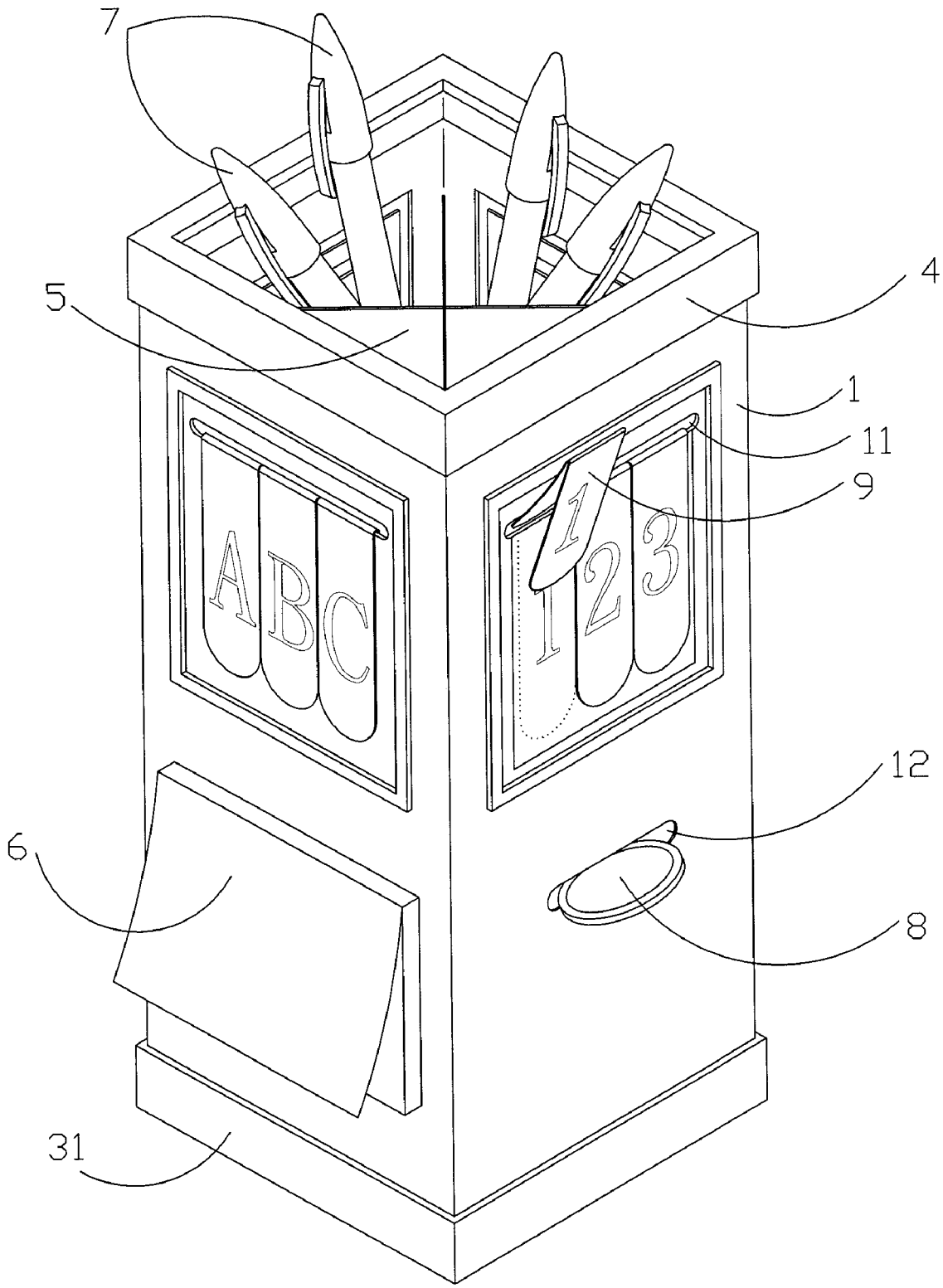
FIG. 4 shows the multifunctional box organizer of the present invention in use.

The main body 1 may be provided on outer surfaces of the four sides with designs corresponding to the shapes of the magnetic bookmarks 9, so that a user may use the four sides of the main body 1 as puzzles when hanging the magnetic bookmarks 9 on the main body 1, making the box organizer of the present invention more interesting for use. In the illustrated preferred embodiment, the main body 1 is a rectangular hollow sleeve with four slits 11. However, it is understood the main body 1 may be of any other geometrical shape, such as a closed annular member with two open ends; and the number of the slits 11 is not limited to four, but may be one, two, three, or more than four. The main body 1 may be made of a magnetic material for the magnetic bookmarks 9 to magnetically attach thereto. The main body 1 is also provided on one of the four sides with a coin slot 12, via which a coin 8 may be inserted, as shown in FIG. 4. However, it is understood a paper money (not shown) may also be inserted into the main body 1 via the coin slot 12.

The enclosure 2 is formed by bending a predetermined sheet material, and sized to be fitly received in a lower part of the main body 1. As shown, the enclosure 2 includes a closed top wall 21 and four sidewalls 22 integrally downward extended from four edges of the top wall 21, so as to define an internal storage space 23. One of the four sidewalls 22 is provided with an opening 221 corresponding to the coin slot 12 on one side of the main body 1, so that the coin 8 or other paper money inserted through the coin slot 12 would fall and be collected in the storage space 23 of the enclosure 2, allowing the box organizer of the present invention to serve as a saving box.

The bottom cover assembly 3 includes a cover 31 and a cap 32. The cover 31 is correspondingly closed to a lower open end of the main body 1 and provided with a hole 311, to which the cap 32 is openably screwed. When the cap 32 is turned to open the hole 311, coins 8 or paper money may be taken out of the storage space 23 of the enclosure 2.

The top binding frame 4 is a ring-shaped member for fitly mounting around the upper open end of the main body 1, thus reinforcing the structural strength of the box organizer of the present invention.

The partition 5 has an X-shaped cross section for fitly positioning in the main body 1 above the top wall 21 of the enclosure 2 to divide an inner space of the main body 1 above the enclosure 2 into four subspaces. With the X-shaped partition 5, pens 7 and other things may be substantially upright held in the four subspaces in the main body 1 above the enclosure 2 without becoming tilted or disorderly interlaced with one another, as shown in FIG. 4. The X-shaped partition 5 also enables a user to easily sort different articles being held in the main body 1. In the illustrated preferred embodiment of the present invention, the partition 5 is assembled from two detachably intersecting partition walls 51.

A memo pad 6 may be externally attached to one of the four sides of the main body 1 to be easily accessed by a user, as shown in FIG. 4.

With the above arrangements, the box organizer according to the present invention may be used to hold not only magnetic bookmarks, but also pens, coins, memo pad, etc., and is therefore a multifunctional product with excellent applicability.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A multifunctional box organizer, comprising a main body in the form of a hollow member with an upper and a lower open end, and the main body being provided on a peripheral wall thereof near the upper open end with at least one slit, via which at least one magnetic bookmark is partially extended therein and then bent to magnetically attach to the main body.

2. The multifunctional box organizer as claimed in claim 1, further comprising an enclosure fitly received in a lower part of the main body, and a bottom cover assembly mounted to and thereby closing the lower open end of the main body; wherein the main body is provided on the peripheral wall with a coin slot, such that the coil slot is located at a distance from the at least one slit; the enclosure together with the bottom cover assembly defining an inner storage space, and being provided on a sidewall with an opening corresponding to the coin slot on the main body to allow coins or paper money to be inserted through the coin slot and the opening to fall and be collected in the inner storage space; and the bottom cover assembly including a cover having a hole, and a cap openably screwed to the hole on the cover, so that coins and paper money collected in the enclosure may be taken out by turning open the cap.

3. The multifunctional box organizer as claimed in claim 2, further comprising a partition fitly positioned in the main body above the enclosure to divide the inner storage space of the main body above the enclosure into a plurality of subspaces.

4. The multifunctional box organizer as claimed in claim 3, wherein the partition is assembled from two intersecting partition walls.

5. The multifunctional box organizer as claimed in claim 2, further comprising a top binding frame mounted around the upper open end of the main body.

6. The multifunctional box organizer as claimed in claim 2, further comprising a memo pad attached to the peripheral wall of the main body.

7. The multifunctional box organizer as claimed in claim 3, further comprising a top binding frame mounted around the upper open end of the main body.

8. The multifunctional box organizer as claimed in claim 3, further comprising a memo pad attached to the peripheral wall of the main body.

9. The multifunctional box organizer as claimed in claim 1, further comprising a top binding frame mounted around the upper open end of the main body.

10. The multifunctional box organizer as claimed in claim 1, further comprising a memo pad attached to the peripheral wall of the main body.

* * * * *